US005247492A

United States Patent [19]

Pan

[11] Patent Number: 5,247,492

[45] Date of Patent: Sep. 21, 1993

[54] PROJECTION CLOCK

[76] Inventor: Chih H. Pan, P.O. Box 82-144, Taipei, Taiwan

[21] Appl. No.: 959,386

[22] Filed: Oct. 13, 1992

[51] Int. Cl.[5] ..... G04B 19/00; G04C 19/00

[52] U.S. Cl. ..... 368/79; 368/239

[58] Field of Search ..... 368/67, 76, 79, 223, 368/227, 239

[56] References Cited

U.S. PATENT DOCUMENTS

| | | | |
|---|---|---|---|
| 1,579,880 | 4/1926 | Meissner et al. | 368/79 |
| 2,201,376 | 5/1940 | Prins | 368/79 |
| 2,726,571 | 12/1955 | Chang | 368/79 |
| 3,136,210 | 6/1964 | Barrett | 368/79 |
| 4,253,170 | 2/1981 | Meisner | 368/67 |
| 4,374,623 | 2/1983 | Simon | 368/79 |

*Primary Examiner*—Vit W. Miska
*Attorney, Agent, or Firm*—Alfred Lei

[57] ABSTRACT

A projection clock and in particular to one including a housing, the housing being provided at one end with a light bulb and a converging lens in alignment with the light bulb, and at the other end with a clock having a reflective dial with laterally inverted figures marking hours, and a cover engaged with the housing and having a diverging lens in alignment with the reflective dial of the clock and a converging member aligned with the light bulb.

3 Claims, 4 Drawing Sheets

PROJECTION CLOCK

BACKGROUND OF THE INVENTION

The conventional clock is an instrument for measuring and indicating time. Predecessors of the clock were the SUNDIAL, the HOURGLAS and the CLESYDRA. However, all clocks sold on the present market are very much inconvenient for use at night.

However, it is an object of the present invention to provide a projection clock which is especially designed for use at night.

SUMMARY OF THE INVENTION

This invention relates to a projection clock.

It is the primary object of the present invention to provide a projection clock which may project a clock dial on the wall thereby making it visible at night.

It is another object of the present invention to provide a projection clock which may be used as a bed lamp.

It is still another object of the present invention to provide a projection clock which is simple in construction.

It is still another object of the present invention to provide a projection clock which is facile to produce.

It is a further object of the present invention to provide a projection clock which is inexpensive to manufacture.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
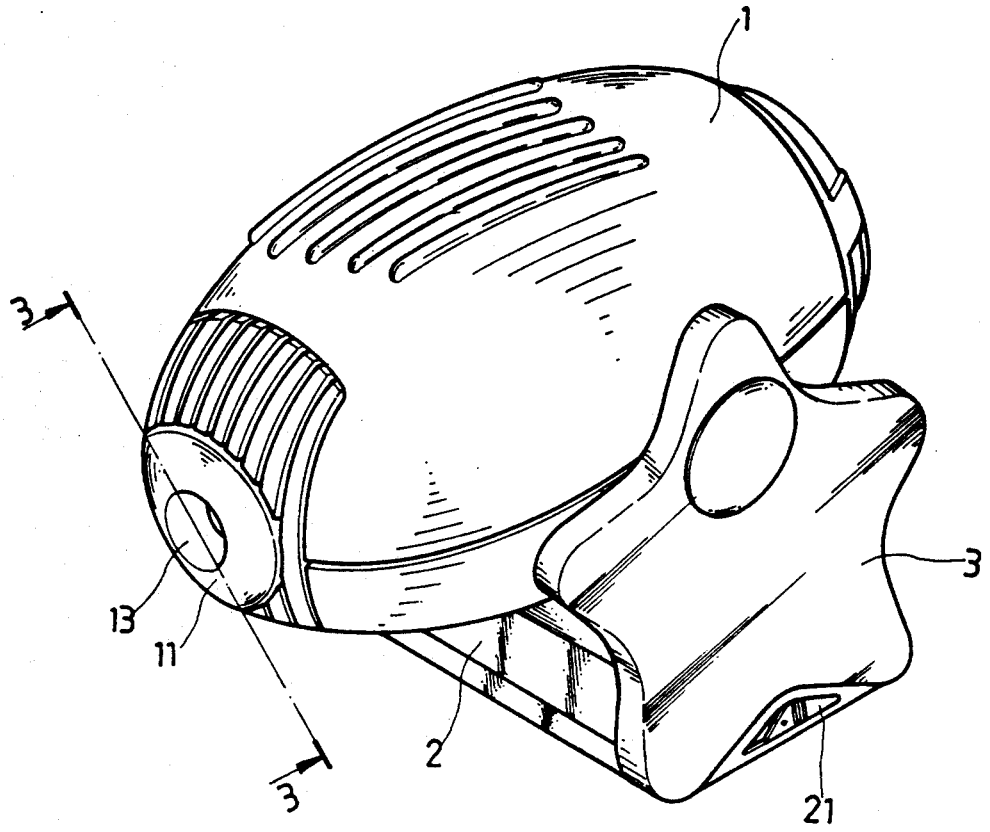
FIG. 1 is a perspective view of the present invention.

With reference to the drawings and in particular to FIG. 1 thereof, the projection clock according to the present invention mainly comprises an elliptical housing 1, a base 2, and two star-shaped supporters 3. The housing 1 is pivotally mounted between the two star-shaped supporters 3 so that the housing 1 may be moved up and down.

Figure 2:
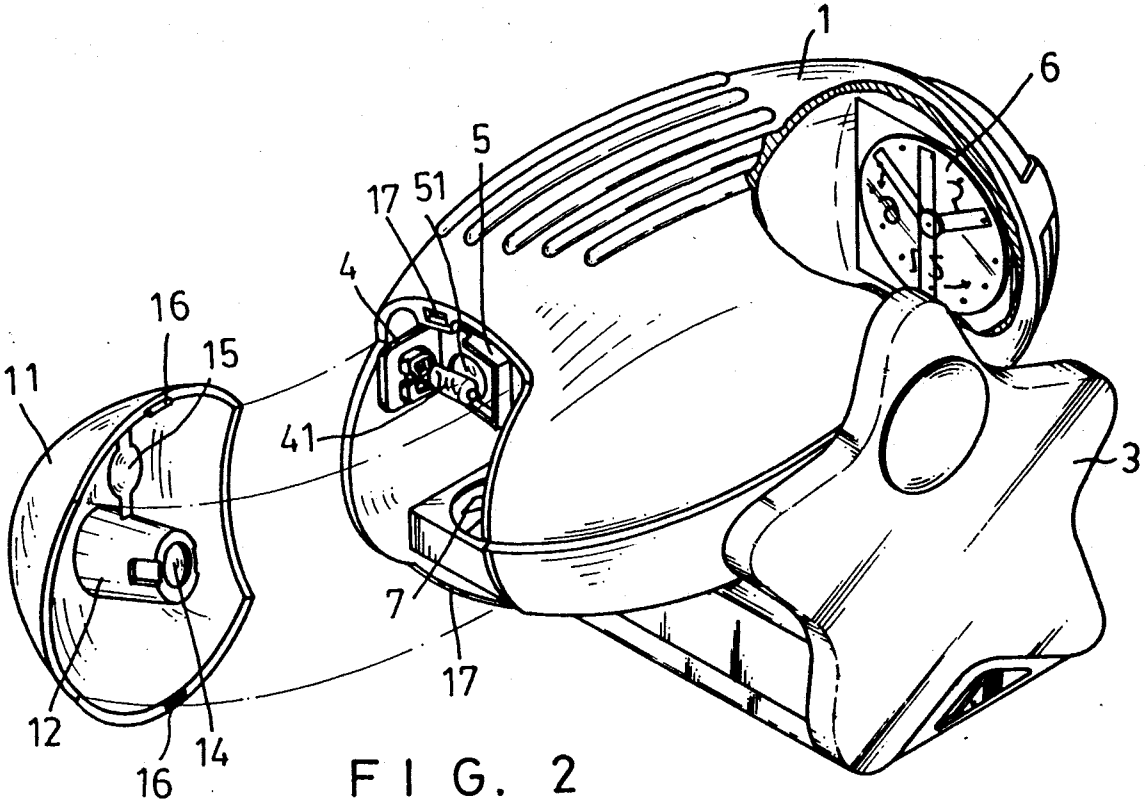
FIG. 2 is a cutaway view of the present invention.

As illustrated in FIG. 2, the housing 1 is provided in the front end with a cover 11 on the center of which there is a conical member 12 having a hole 13 extending through the cover 11. On the inner end of the conical member 12 is mounted a diverging lens 14. A converging member 15 is mounted between the conical member 12 and the inner side of the cover 11. Further, the cover 11 is provided with a plurality of protuberances 16 adapted to the slits 17 of the housing 1 so that the cover 11 may be engaged with the housing 1.

A socket 4 is mounted in the interior of the front end of the housing 1, in which is fitted a light bulb 41 aligned with the converging member 15. Further, a frame 5 with a converging lens 51 at its center is installed in the interior of the front end of the housing 1. A clock with a reflecting dial 6 on which there are laterally inverted figures marking the hours is mounted at the rear end of the interior of the housing 1. The clock is disposed so that the reflecting dial 6 is in alignment with the diverging lens 14. In addition, a fan 7 is mounted under the light bulb 41 for dissipating the heat evolved therefrom.

Figure 3:
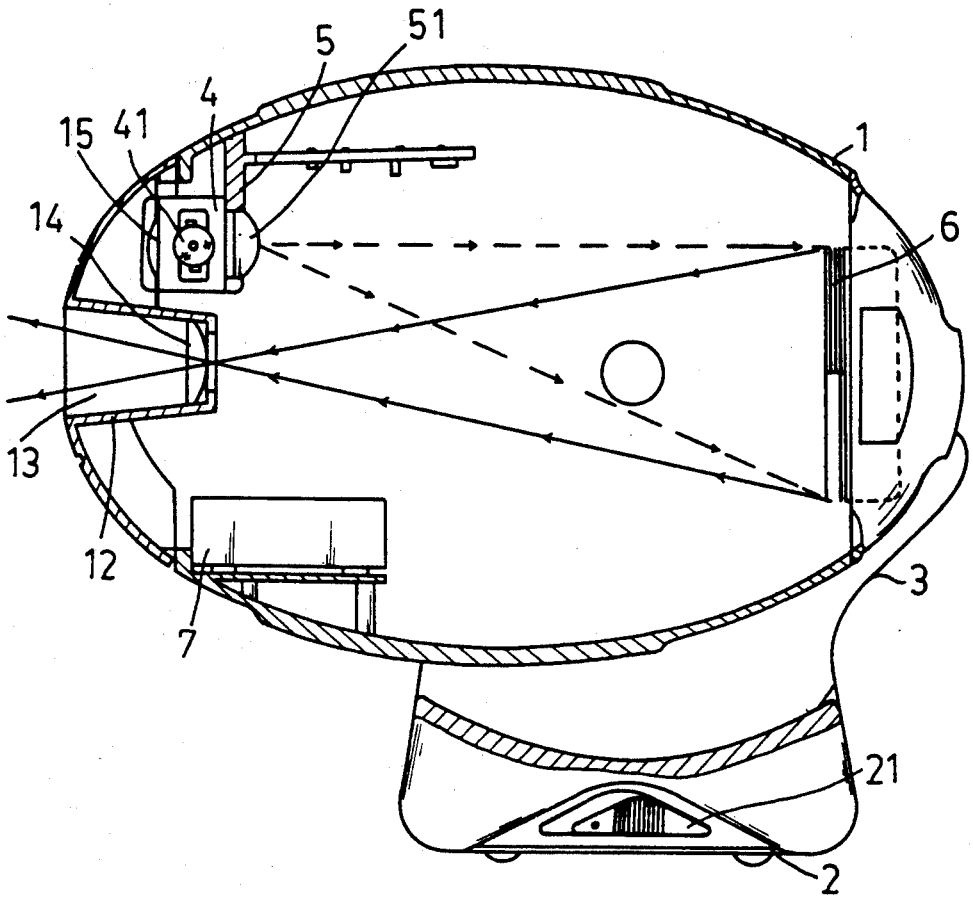
FIG. 3 is a sectional view taken along line A—A of FIG. 1.
Figure 4:
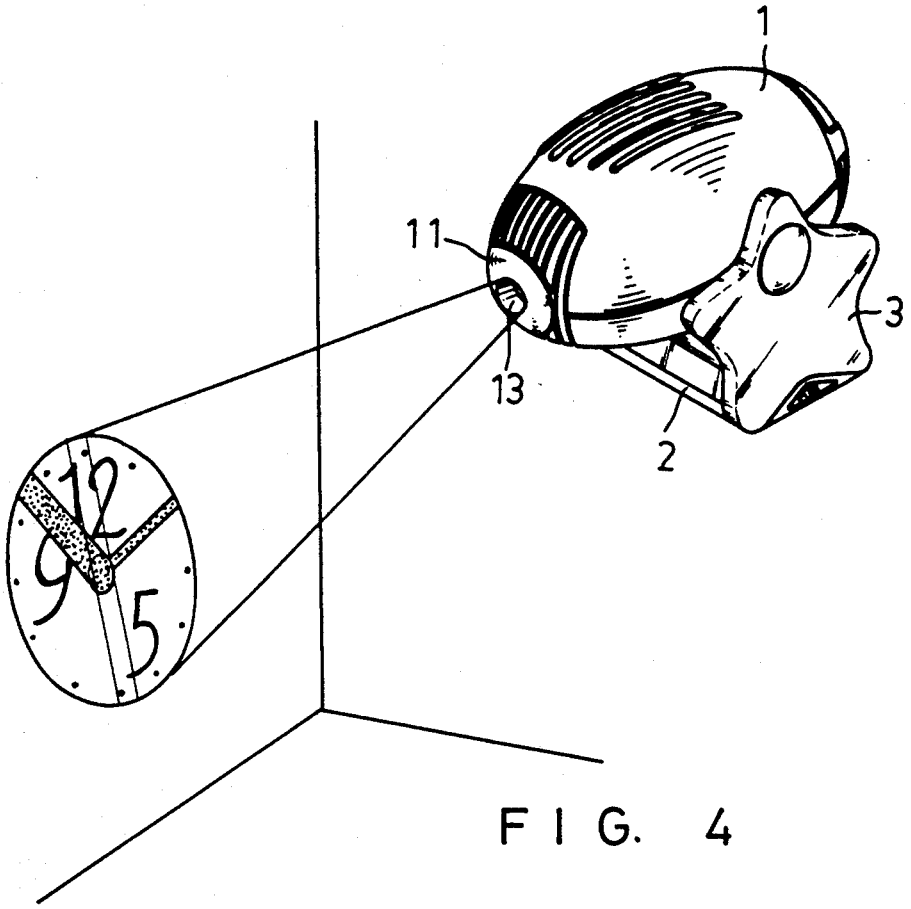
FIG. 4 is a working view of the present invention.

Referring to FIG. 3, the clock is supplied by dry batteries (not shown), while the light bulb 41 and the fan 7 by external power (not shown). A switch 21 is mounted on the base 2, which is electrically connected with the light bulb 41 and the fan 7 so that when the switch 21 is turned on, the light bulb 41 will give light and the fan 7 will be actuated to dissipate the heat evolved from the light bulb 41. In the meantime, the light given by the light bulb 41 will be concentrated by the converging member 15 which will in turn reflect the light to the dial 6 through the converging lens 51. Thereafter, the reflecting dial 6 will in turn project the light on a wall through the diverging lens 14, resulting in a projection clock (see FIG. 4).

In conclusion, the projection clock according to this invention is especially designed for use at night and may be also used as a lamp.

Although the present invention has been described with a certain degree of particularly, it is understood that the present disclosure is made by way of example only and that numerous changes in the detail of construction and the combination and arrangement of parts may be resorted to without departing from the spirit and scope of the invention as hereinafter claimed.

I claim:

1. A projection clock comprising:

a housing, said housing being provided at one end with a light bulb and a converging lens in alignment with said light bulb, and at the other end with a clock having a reflective dial with laterally inverted figures marking hours; and a cover engaged with said housing and having a diverging lens in alignment with the reflective dial of said clock and a converging member aligned with said light bulb.

2. The projection clock as claimed in claim 1, wherein said housing is pivotally mounted on a base.

3. The projection clock as claimed in claim 1, further comprising a fan mounted under said light bulb.

* * * * *